US005520064A

United States Patent [19]

Hickerson et al.

[11] Patent Number: 5,520,064

[45] Date of Patent: May 28, 1996

[54] PORTABLE RESCUE TOOL

[75] Inventors: William Hickerson, Hardyston Township; John D. McCarthy, West Milford; Bradley C. Litz, Montville; Edward A. Mayer, West Orange, all of N.J.

[73] Assignee: Curtiss Wright Flight Systems Inc., Fairfield, N.J.

[21] Appl. No.: 410,817

[22] Filed: Mar. 27, 1995

Related U.S. Application Data

[63] Continuation-in-part of Ser. No. 289,842, Aug. 12, 1994, which is a continuation of Ser. No. 94,502, Jul. 20, 1993, abandoned, which is a continuation-in-part of Ser. No. 952,688, Sep. 29, 1992, Pat. No. 5,297,780.

[51] Int. Cl.[6] ..... B66F 3/00

[52] U.S. Cl. ..... 74/421 R; 192/20

[58] Field of Search ..... 74/421 R; 192/20; 901/38

[56] References Cited

U.S. PATENT DOCUMENTS

| | | | |
|---|---|---|---|
| 4,825,723 | 5/1989 | Martin | 475/342 |
| 4,842,249 | 6/1989 | Weigand | 254/93 R |
| 4,896,862 | 1/1990 | Ganley | 254/1 |
| 5,085,407 | 2/1992 | Lonon | 254/103 |
| 5,106,354 | 4/1992 | Russ et al. | 475/342 |
| 5,120,285 | 6/1992 | Grimm | 475/342 |
| 5,297,780 | 3/1994 | Hickerson | 254/124 |

*Primary Examiner*—Dirk Wright
*Attorney, Agent, or Firm*—Klauber & Jackson

[57] ABSTRACT

A portable rescue tool which operates off electric power and which comprises a clutch mechanism for orienting high torque spreading and/or cutting motion that is produced by the portable rescue tool in a plurality of possible directions with respect to the portable rescue tool. The portable rescue tool comprises a rotary switch for controlling the operation of the portable rescue tool, a DC motor connected to the rotary switch for providing a high speed, low torque output, a gear reduction assembly coupled to the DC motor for decreasing the speed and increasing the torque of the DC motor output, an actuator assembly coupled to the gear reduction assembly for providing a low speed, high torque output, and a clutch mechanism associated with the actuator assembly for orienting the direction of the low speed, high torque output with respect to the portable rescue tool.

10 Claims, 6 Drawing Sheets

PORTABLE RESCUE TOOL

CROSS-REFERENCE TO RELATED APPLICATIONS

This is a continuation-in-part application of file-wrapper-continuation application Ser. No. 08/289,842, which was filed on Aug. 12, 1994, which is presently pending, and which is the file-wrapper-continuation application of continuation-in-part application Ser. No. 08/094,502, which was filed on Jul. 20, 1993, which has been abandoned, and which is the continuation-in-part application of patent application Ser. No. 07/952,688, which was filed on Sep. 29, 1992, and which has been issued as U.S. Pat. No. 5,297,780.

FIELD OF THE INVENTION

This invention relates to portable devices which deliver spreading and/or cutting motion under high loads, and, more particularly, to a portable rescue tool having a clutch mechanism for orienting the spreading and/or cutting motion provided by the portable rescue tool in a plurality of possible directions with respect to the portable rescue tool.

BACKGROUND OF THE INVENTION

Rescue tools known as "Jaws of Life" (registered trademark) type devices are specialized tools used by various rescue personnel such as police, firemen, and paramedics generally for the purpose of extricating accident victims from vehicles whose exits have been rendered inoperable. These tools require spreading and closing forces for opening or ripping apart inoperable doors or for cutting through relatively thick metal layers. Pushing and pulling forces of 7,000 to 15,000 pounds at the tips of these tools are considered to be normal for the proper operation of such tools. In the past, in order to achieve such high forces, the tools have been almost exclusively hydraulic and powered by gasoline engines, for example as described in U.S. Pat. No. 4,842,249.

With self contained hydraulic and gasoline units, the tools are somewhat portable for use under the adverse conditions that are commonly encountered during the rescue of accident victims. However, many of these "portable" units weigh in excess of 200 pounds. Furthermore, many of these "portable" units require at least two persons for operation and/or transport since they have separated power and operation units.

Some tools, such as the ones described in U.S. Pat. No. 4,896,862, are designed as separate jaw elements for use with various available powered inputs such as pneumatic or hydraulic pumps or electric motors which drive threaded actuating elements. Though these tools, and others, are described as being powered by an electric motor, most devices are powered by gasoline or other fuel operated devices which provide the requisite driving power in a portable fashion. Electric power sources are not readily available in most emergency situations and portable batteries have not been considered capable of providing the requisite torque for effective operation of such devices.

As a result of the widespread use of hydraulic systems with fuel operated powering, as a general proposition, many of the existing tools also require constant costly maintenance of various components in order to maintain effectiveness.

The major drawbacks for most hydraulic system tools include the inability to generate full tip spreading force at the time of the initial spreading application, the time at which such forces are needed most. Also, gasoline powered hydraulic devices are very noisy and, because of fuel containment exigencies, require special transport compartments. Other major drawbacks of fuel operated power units include the detrimental susceptibility to environmental conditions including explosive atmospheres and inclement weather. A gasoline powered unit is dangerous to operate under many accident conditions, especially where speed is required in the act of saving one or more victims from the imminent harm of spreading flames.

In view of the above, it would be both novel and desirable to provide a portable rescue tool which operates off electric power and which comprises a clutch mechanism for orienting high torque spreading and/or cutting motion that is produced by the portable rescue tool in a plurality of possible directions with respect to the portable rescue tool.

SUMMARY OF THE INVENTION

The present invention contemplates a portable rescue tool which operates off electric power and which comprises a clutch mechanism for orienting high torque spreading and/or cutting motion that is produced by the portable rescue tool in a plurality of possible directions with respect to the portable rescue tool. The portable rescue tool comprises a rotary switch for controlling the operation of the portable rescue tool, a DC motor, connected to the rotary switch, for providing a high speed, low torque output, a gear reduction assembly, coupled to the DC motor, for decreasing the speed and increasing the torque of the DC motor output, an actuator assembly, coupled to the gear reduction assembly, for providing a low speed, high torque output, and a clutch mechanism, associated with the actuator assembly, for orienting the direction of the low speed, high torque output with respect to the portable rescue tool.

Accordingly, the primary objective of the present invention is to provide a portable rescue tool which operates off electric power and which comprises a clutch mechanism for orienting high torque spreading and/or cutting motion that is produced by the portable rescue tool in a plurality of possible directions with respect to the portable rescue tool.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now be made to the appended drawings. The drawings should not be construed as limiting the present invention, but are intended to be exemplary only.

DETAILED DESCRIPTION OF THE PREFERRED EMBODIMENT

Figure 1:
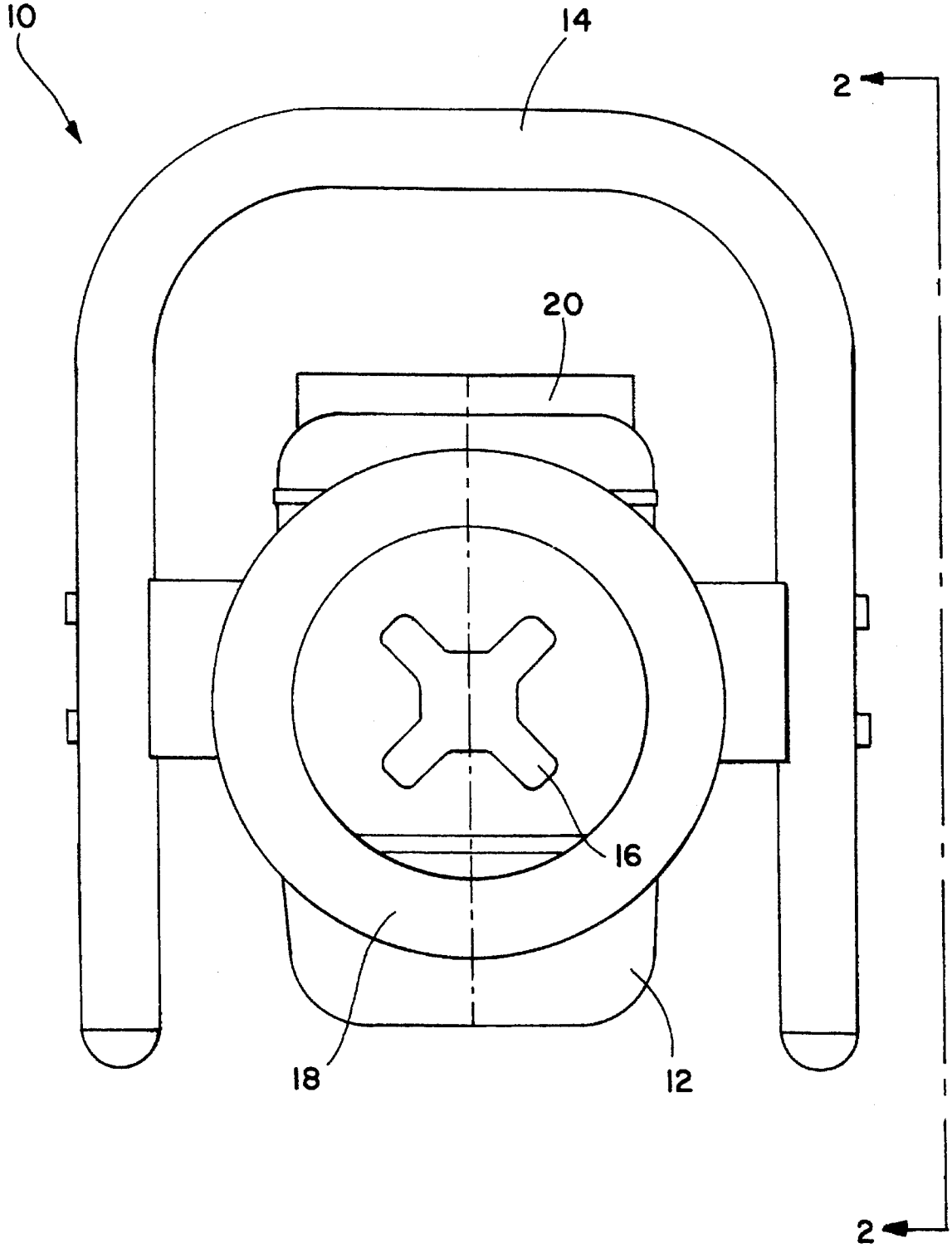
FIG. 1 is an end view of a portable rescue tool according to the present invention.
Figure 2:
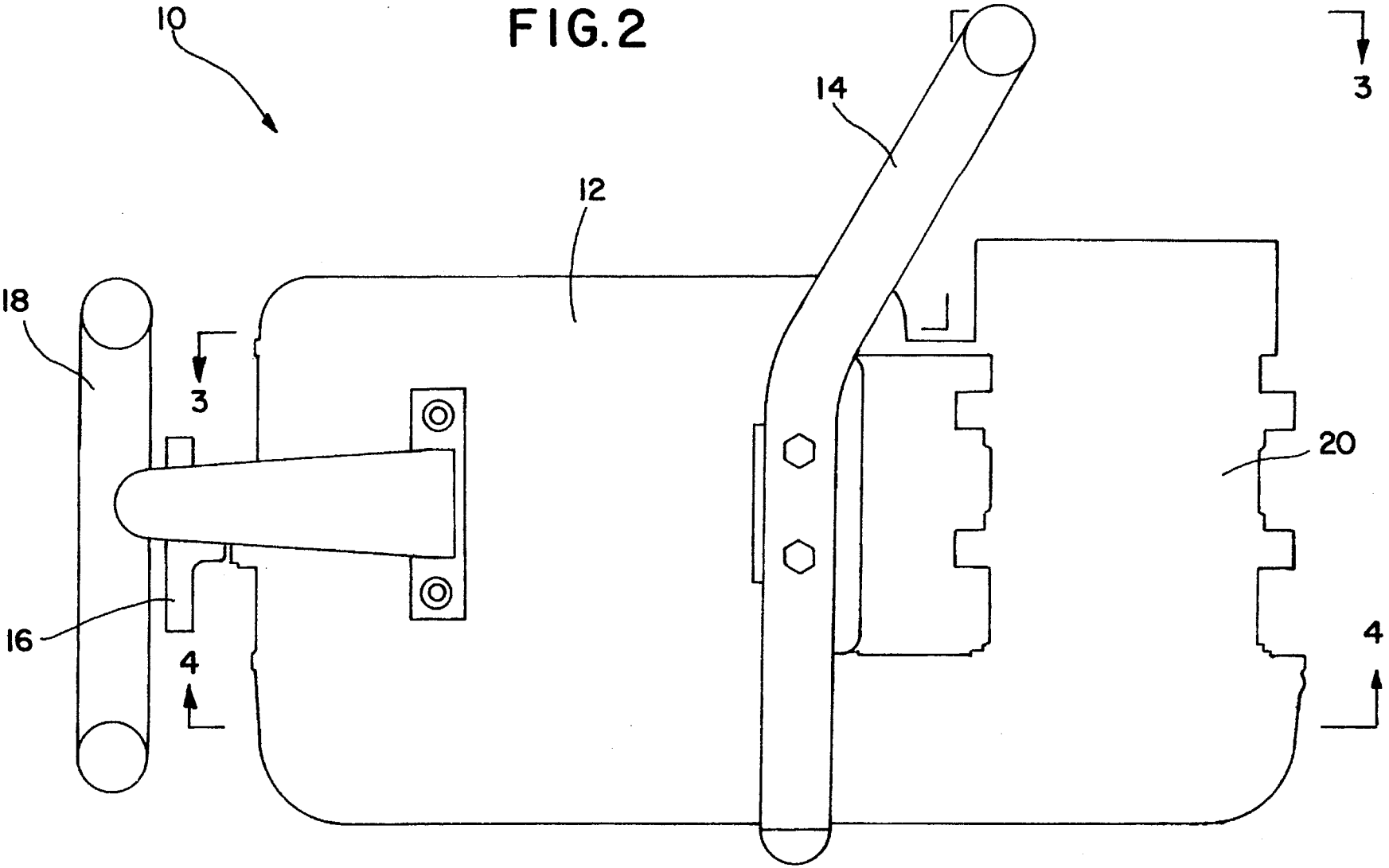
FIG. 2 is a side view of the portable rescue tool shown in FIG. 1 taken along line 2—2 of FIG. 1.

Referring to FIGS. 1 and 2, there is shown a portable rescue tool 10 according to the present invention. The portable rescue tool 10 comprises a main body 12, a first handle 14 secured to the main body 12 for gripping the same, a rotary switch 16 secured to the main body 12 for controlling the operation of the portable rescue tool 10, a second handle 18 secured to the main body 12 for also gripping the main body 12 and for protecting the rotary switch 16, and an actuator assembly 20 operatively connected to the main body 12 for providing a low speed, high torque output for performing rescue tool functions.

Although not shown herein, rescue tool implements, such as spreaders and cutters, are removably connected to the actuator assembly 20 for actually performing rescue tool functions. Such rescue tool implements are described in detail in the file-wrapper-continuation application Ser. No. 08/289,842, which was filed on Aug. 12, 1994, and which is presently pending.

Figure 3:
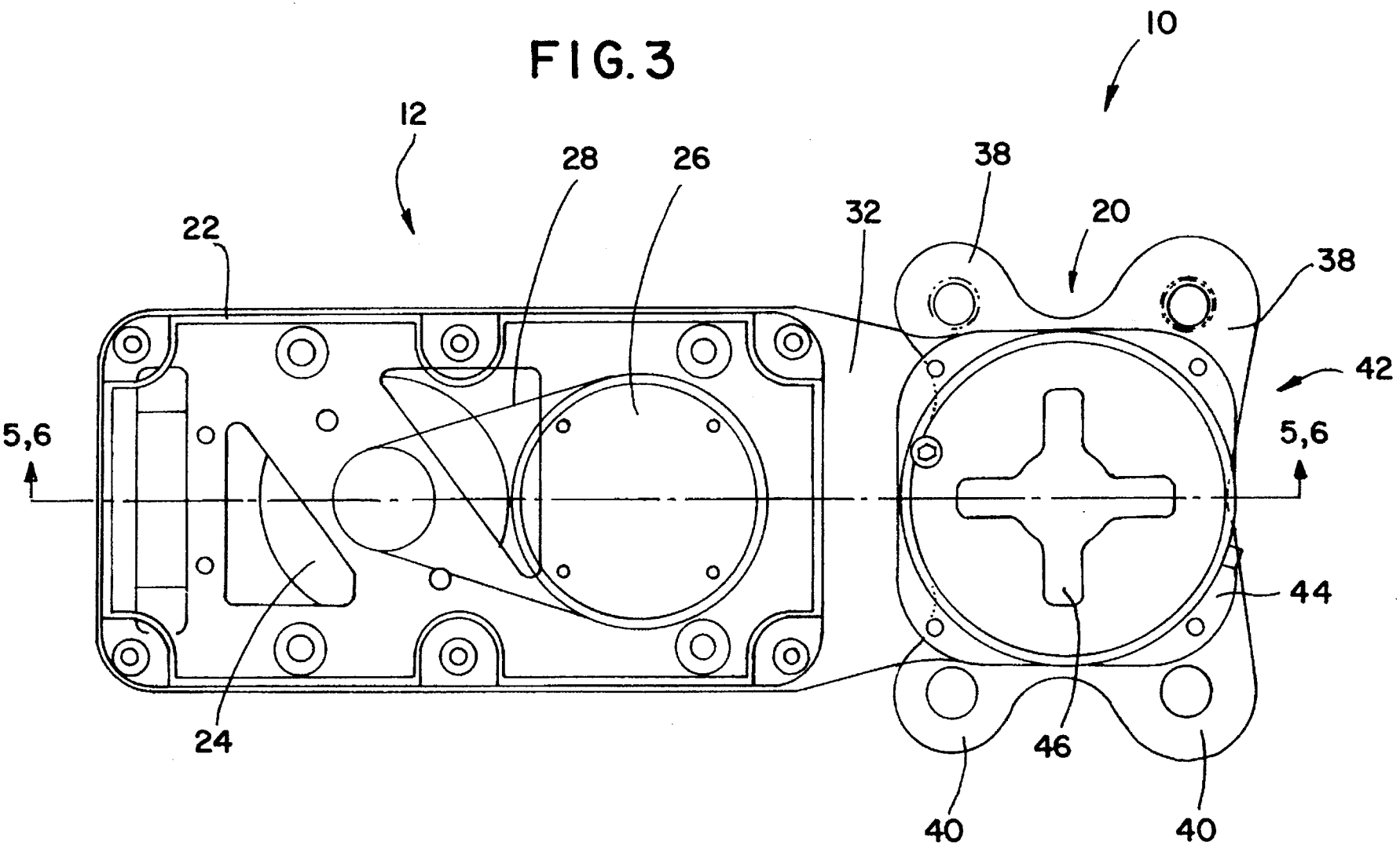
FIG. 3 is a partial cross-sectional view of the portable rescue tool shown in FIG. 1 with the first handle removed taken along line 3—3 of FIG. 2.
Figure 4:
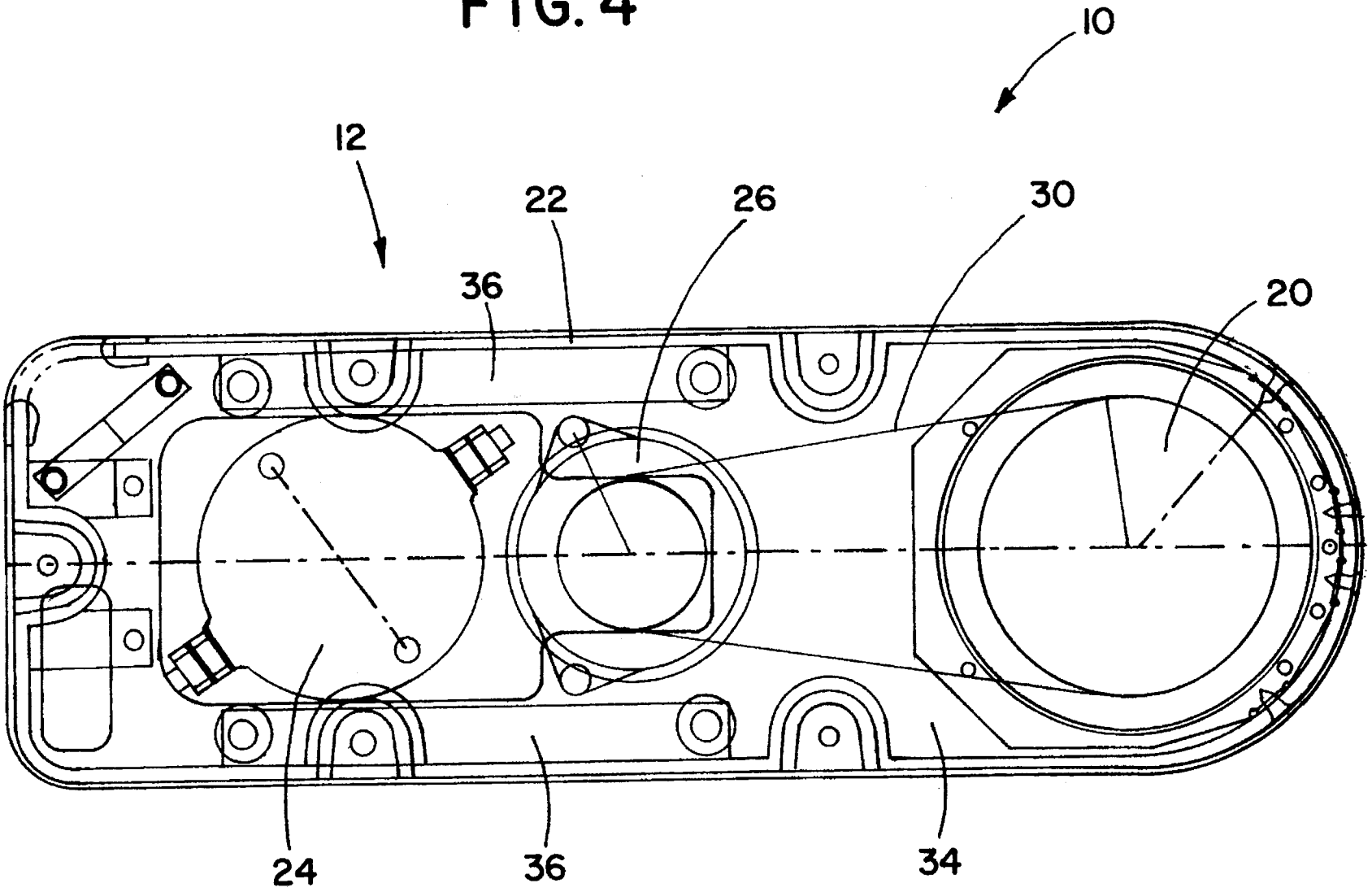
FIG. 4 is a cross-sectional view of the portable rescue tool shown in FIG. 1 with the first handle removed taken along line 4—4 of FIG. 2.

Referring to FIGS. 3 and 4, there are shown a partial cross-sectional view and a cross-sectional view of the portable rescue tool 10, respectively. In these views, the main body 12 is shown comprising a housing 22, a DC motor 24 disposed within the housing 22, a gear reduction assembly 26 also disposed within the housing 22, a first chain 28 for operatively coupling the DC motor 24 to the gear reduction assembly 26, and a second chain 30 for operatively coupling the gear reduction assembly 26 to the actuator assembly 20.

A first (upper) plate 32 and a second (lower) plate 34 pass horizontally through the main body 12 and outward thereof. The upper and lower plates 32,34 are designed with cut-outs formed therein so as to mate with and allow the DC motor 24 and the gear reduction assembly 26 to be secured thereto within the housing 22, and allow the actuator assembly 20 to be rotatably mounted thereto outside the housing 22. The upper and lower plates 32,34 are fabricated of relatively high strength aluminum and are secured together by a pair of spacers 36, which are also fabricated of relatively high strength aluminum, so as to provide strength and rigidity to the entire portable rescue tool 10.

The actuator assembly 20 typically comprises a rotary, multiple stage gearbox having movable ring gear lugs 38 and fixed ring gear lugs 40 to which spreading and/or cutting arms are attached. A clutch mechanism 42, comprising a clutch housing 44 and a clutch handle 46, is utilized to orient and mount the actuator assembly 20 in a plurality of possible positions on the upper and lower plates 32,34.

Figure 5:
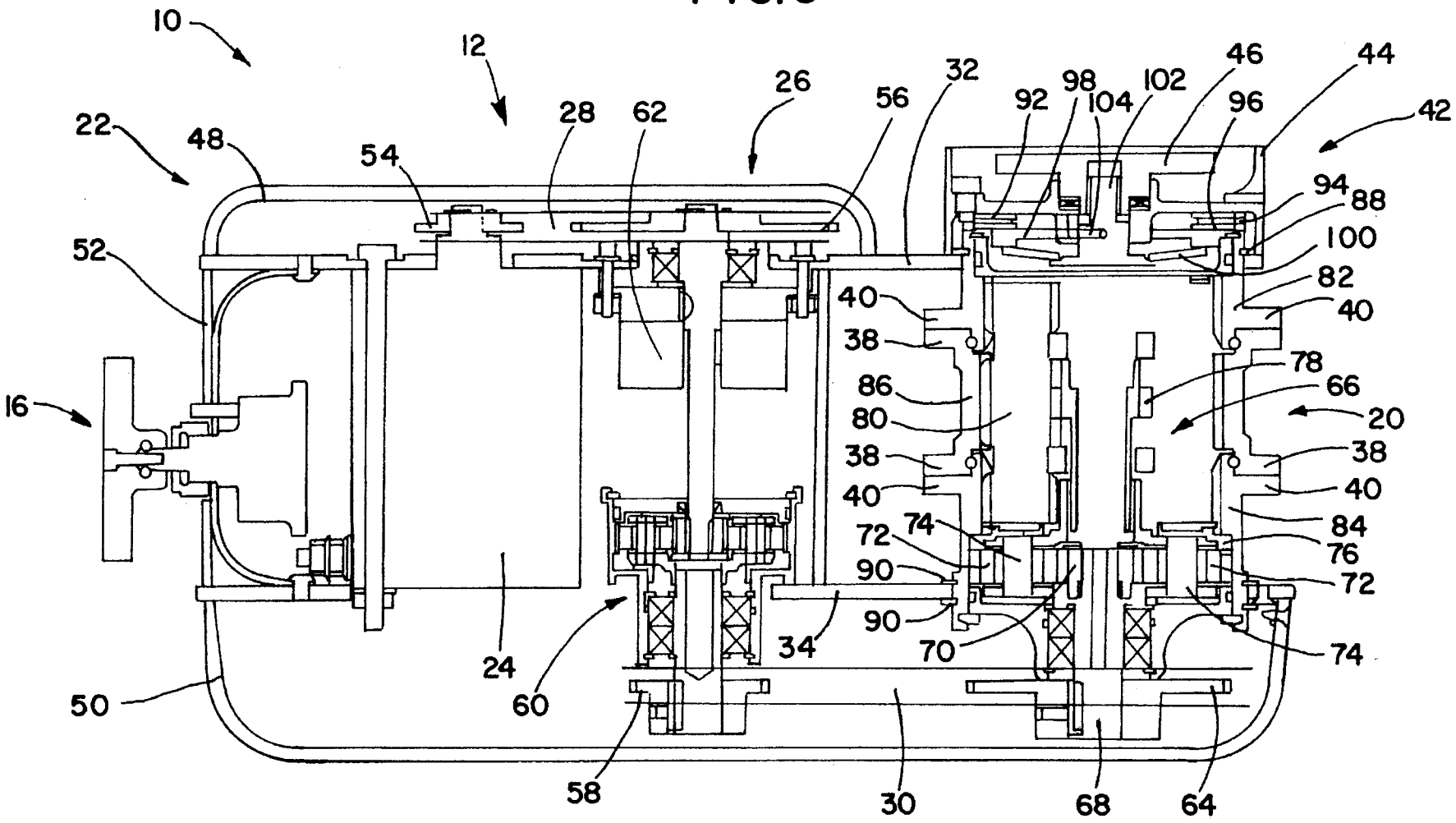
FIG. 5 is a cross-sectional view of the portable rescue tool shown in FIG. 1 with the first and second handles removed taken along line 5—5 of FIG. 3.
Figure 6:
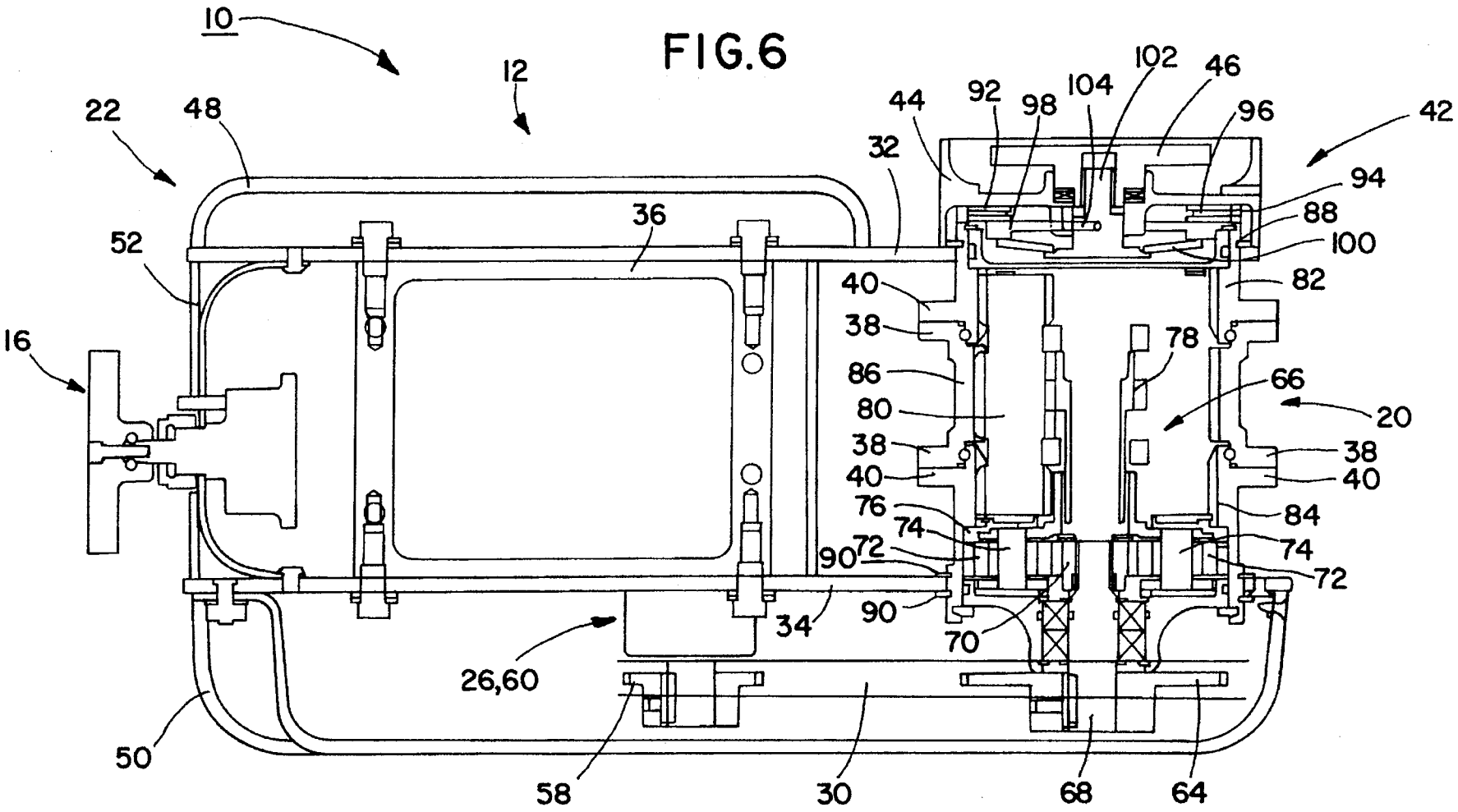
FIG. 6 is a cross-sectional view of the portable rescue tool shown in FIG. 1 with the first and second handles and the DC motor and gear reduction assembly removed taken along line 6—6 of FIG. 3.

Referring to FIGS. 5 and 6, there are shown cross-sectional views of the portable rescue tool 10. The housing 22 comprises a top section 48 which is secured to the upper plate 32, a bottom section 50 which is secured to the lower plate 34, and a middle section 52 which is secured to the pair of spacers 36 along with the first handle 14. The rotary switch 16 is secured to the upper and lower plates 32,34 through the middle section 52 of the housing 22. The rotary switch 16 is used to select the mode of the low speed, high torque output (i.e. either opening or closing the spreading and/or cutting arms). The rotary switch 16 operates by connecting (or not connecting) the DC motor 24 to an external DC power source (not shown). Depending upon the position of the rotary switch 16, DC power is provided to the terminals of the DC motor 24 so as to energize the DC motor 24 and thereby provide a high speed, low torque output in one of two rotational directions. The rotary switch 16 is typically a three-positional switch with a first position being a clockwise (CW) direction position, a second position being a counter-clockwise (CCW) direction position, and a third position being a neutral or off position. The DC motor 24 is typically a self-contained, explosion-proof electric motor having an output sprocket 54 mounted to its rotor shaft.

The gear reduction assembly 26 has an input sprocket 56, an output sprocket 58, and a gear assembly 60 all designed for decreasing the speed and increasing the torque of the DC motor output. The gear reduction assembly 26 also has brake assembly 62 that is typically a fail-safe, electrically-off brake which is connected in parallel across the terminals of the DC motor 24. Thus, whenever the DC motor 24 is not provided with DC power, the brake assembly 62 is engaged. The first chain 28 operatively couples the output sprocket 54 of the DC motor 24 and the input sprocket 56 of the gear reduction assembly 26.

The actuator assembly 20 has an input sprocket 64 and a gear assembly 66 designed for decreasing the speed and increasing the torque of the gear reduction assembly output. The second chain 30 operatively couples the output sprocket 58 of the gear reduction assembly 26 and the input sprocket 64 of the actuator assembly 20.

The gear assembly 66 comprises a splined shaft 68 onto which the input sprocket 64 is mounted, a sun gear 70 spline coupled to the splined shaft 68, a plurality of planet gears 72 gear coupled to the sun gear 70, a plurality of planet shafts 74 corresponding to and associated with the plurality of planet gears 72, a splined carrier 76 operatively engaged with the plurality of planet shafts 74, a sun gear 78 splined coupled to the splined carrier 76, a plurality of spindle gears 80 gear coupled to the sun gear 78, upper and lower fixed ring gears 82 and 84 gear coupled to the plurality of spindle gears 80 and having the fixed ring gear lugs 40 formed as a part thereof, and a movable ring gear 86 gear coupled to the plurality of spindle gears 80 and having the movable ring gear lugs 38 formed as a part thereof. As previously mentioned, spreading and/or cutting arms (not shown) are attached to the movable ring gear lugs 38 and the fixed ring gear lugs 40 so as to perform rescue tool functions. It should be noted that the total gear reduction from the output of the DC motor 24 to the output of the actuator assembly 20 (i.e. the opening or the closing motion of the spreading and/or cutting arms) is typically 6000:1.

The actuator assembly 20 is rotatably mounted to the upper and lower plates 32,34 with a snap ring 88 and retaining rings 90, respectively. As previously mentioned, the clutch mechanism 42 is utilized to orient and mount the actuator assembly 20 in a plurality of possible positions on the upper and lower plates 32,34. Also as previously mentioned, the clutch mechanism 42 comprises the clutch housing 44 and the clutch handle 46.

The clutch housing 44 is fixedly secured to the upper plate 32, and a first friction disk 92 is fixedly secured to the clutch housing 44. A second friction disk 94, disposed directly beneath the first friction disk 92, is keyed to the actuator assembly 20 through the upper fixed ring gear 82. A third friction disk 96 is disposed directly beneath the second friction disk 94 and rests upon a spacer 98. The spacer 98 is biased upwards against the third friction disk 96 by a Bellville spring 100, which is supported by a threaded shaft 102. The threaded shaft 102 passes through the center of the clutch housing 44 and engages the clutch handle 46. Thus, the second friction disk 94, and hence the upper fixed ring gear 82 and the entire actuator assembly 20, may be fixed into position by tightening the second friction disk 94 between the first and second friction disks 92,96 by tightening the clutch handle 46 down along the threaded shaft 102. Alternatively, the actuator assembly 20 may be repositioned, with respect to the upper and lower plates 32,34, by loosening the clutch handle 46 up along the threaded shaft 102 thereby relieving the friction between all of the friction disks 92,94,96 and allowing the actuator assembly 20 to be rotated within the upper and lower plates 32,34. It should be noted that the threaded shaft 102 is kept from rotating by a dowel pin 104 that is keyed to the clutch housing 44.

From the foregoing detailed description, it can be readily understood that the clutch mechanism 42 allows high torque spreading and/or cutting motion that is produced by the portable rescue tool 10 to be oriented in a plurality of possible directions with respect to the portable rescue tool 10. This clutch mechanism 42 operates by simply loosening a clutch handle 46, positioning the actuator assembly 20 within the upper and lower plates 32,34, and then tightening the clutch handle 46. It should be noted that a thrust bearing 106 is disposed between the clutch handle 46 and the clutch housing 44 for assisting in turning the clutch handle 46.

With the present invention portable rescue tool 10 now fully described, it can thus be seen that the primary objective set forth above is efficiently attained and, since certain changes may be made in the above-described portable rescue tool 10 without departing from the scope of the invention, it is intended that all matter contained in the above description or shown in the accompanying drawings shall be interpreted as illustrative and not in a limiting sense.

What is claimed is:

1. A portable rescue tool for providing low speed, high torque output motion in a plurality of possible directions with respect to said portable rescue tool, said portable rescue tool comprising:

an actuator assembly having output means for providing low speed, high torque output motion;

a frame assembly having at least one support member extending therefrom, said at least one support member being adapted for receiving said actuator assembly; and a clutch mechanism for securing said actuator assembly to said at least one support member in a plurality of positions so as to orient said low speed, high torque output motion in a plurality of directions with respect to said frame assembly.

2. The portable rescue tool as defined in claim 1, further comprising a motor, said motor being mounted to said frame assembly.

3. The portable rescue tool as defined in claim 2, wherein said motor is a portable DC motor.

4. The portable rescue tool as defined in claim 1, further comprising a gear reduction assembly, said gear reduction assembly being mounted to said frame assembly.

5. The portable rescue tool as defined in claim 4, wherein said gear reduction assembly is operatively coupled to said actuator assembly.

6. The portable rescue tool as defined in claim 1, wherein said clutch mechanism comprises a clutch housing and a friction disk assembly, wherein a first friction disk is affiliated with said clutch housing, wherein a second friction disk is affiliated with said actuator assembly, and wherein said first friction disk and said second friction disk are spring biased toward each other.

7. A portable rescue tool for providing low speed, high torque output motion in a plurality of possible directions with respect to said portable rescue tool, said portable rescue tool comprising:

an actuator assembly having output means for providing low speed, high torque output motion;

a frame assembly having at least one support member extending therefrom, said at least one support member being adapted for receiving said actuator assembly;

a motor mounted to said frame assembly, said motor being operatively coupled to said actuator assembly; and a clutch mechanism for securing said actuator assembly to said at least one support member in a plurality of positions so as to orient said low speed, high torque output motion in a plurality of directions with respect to said frame assembly.

8. The portable rescue tool as defined in claim 7, wherein said motor is a portable DC motor.

9. The portable rescue tool as defined in claim 7, further comprising a gear reduction assembly, said gear reduction assembly being mounted to said frame assembly, said gear reduction assembly being interposed between said motor and said actuator assembly for operatively coupling the same.

10. The portable rescue tool as defined in claim 7, wherein said clutch mechanism comprises a clutch housing and a friction disk assembly, wherein a first friction disk is affiliated with said clutch housing, wherein a second friction disk is affiliated with said actuator assembly, and wherein said first friction disk and said second friction disk are spring biased toward each other.

* * * * *